United States Patent [19]

Harvie

[11] Patent Number: 4,892,110

[45] Date of Patent: Jan. 9, 1990

[54] HAIR WRAP DEVICE

[76] Inventor: Philis A. Harvie, 227 Rhodes Avenue, Toronto, Ontario, Canada, M41 3A2

[21] Appl. No.: 220,861

[22] Filed: Jul. 18, 1988

[30] Foreign Application Priority Data

Dec. 22, 1987 [CA] Canada ..... 555166

[51] Int. Cl.[4] ..... A45D 8/36

[52] U.S. Cl. ..... 132/273; 132/222

[58] Field of Search ..... 132/273, 274, 275, 212, 132/222, 223, 246, 247, 278

[56] References Cited

U.S. PATENT DOCUMENTS

| | | | |
|---|---|---|---|
| 347,177 | 8/1886 | Heysinger | 132/246 |
| 1,654,775 | 1/1928 | Bailey | 132/222 |
| 1,719,555 | 7/1929 | Lewis et al. | 132/222 |
| 2,560,095 | 7/1951 | Dolphin | 132/275 |
| 2,627,275 | 2/1953 | Kiviluoma | 132/246 |
| 2,924,228 | 2/1960 | McGee | 132/273 |
| 3,471,867 | 10/1969 | Kirchhoff | 132/273 |

*Primary Examiner*—Gene Mancene
*Assistant Examiner*—Adriene J. Lepiane

[57] ABSTRACT

A hair wrap device having a flat ductile resistive metallic member capable of retaining its coiled shape when coiled about a bundle of human hair. Such metallic member is arranged on a backing member of approximately equal thickness to that of the metallic member, and the side edges of the backing member are folded over onto the side thereof on which the metallic member is located creating a gap between the edges of the folded-over portions in which the metallic member is placed. Together the flat ductile metallic member and folded-over portions form a flat surface to which a decorative cover member is attached. To prevent folding-over of the backing member and decorative cover member about the ductile member and consequent loss of aesthetic appeal, especially in the configuration where the ductile member is a thin elongate strip, the backing member is of a material resilient to its flexure and having a memory. Where the hair wrap device may alternatively be coiled along its length or its width about a bundle of hair, the ductile metallic member in a preferred embodiment is of a surface area substantially equal to, but less than, the area of the hair wrap device, to allow such ductile member within the hair wrap device to be coiled and consequently retain its coiled shape regardless of whether the hair wrap device is coiled about its length or its width.

9 Claims, 4 Drawing Sheets

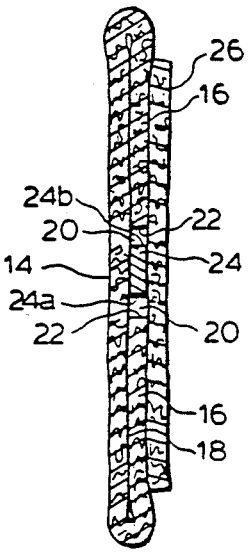
FIG.4.
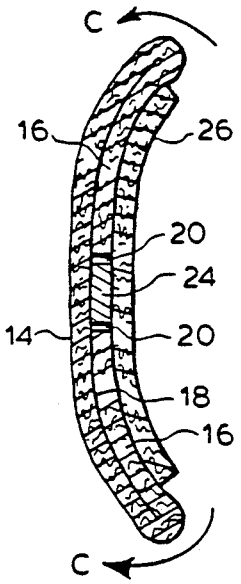
FIG.5.
FIG.6.
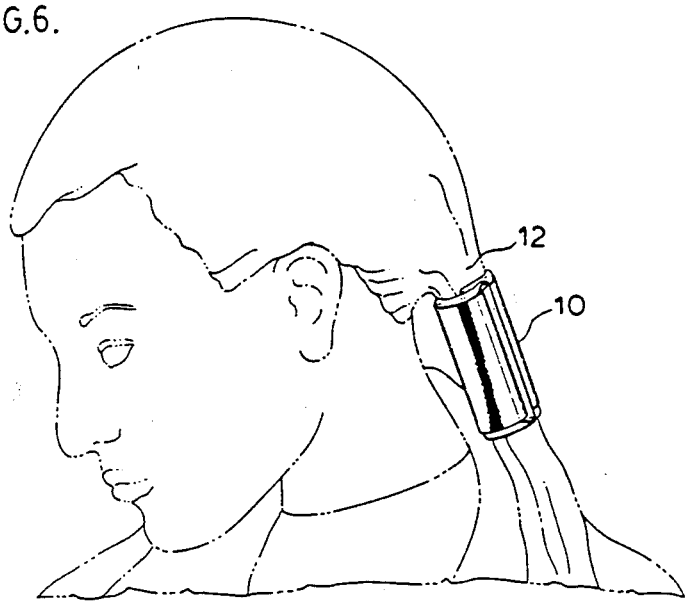

HAIR WRAP DEVICE

INTRODUCTION

The present invention relates to a hair wrap device and more particularly to a hair wrap device containing a ductile metallic member for coiling about a bundle of human hair to retain the hair in said bundle.

BACKGROUND OF THE INVENTION

Numerous known devices exist for wrapping about a bundle of human hair to retain the hair in a bundle. One such example is the elastic band which is commonly used to encircle a bundle of hair to retain it in a bundle, and away from the wearer's eyes. Such device, although inexpensive, lacks any capability for attaching decorative strips thereto for ornamental purposes and for disguising the appearance of the elastic band, which, for aesthetic purposes, is undesirable.

Other devices, such as a two-element hair clip device hinged together at one end, with provision for releasably locking the elements together at the other end, is known. Such device offers the advantage of being able to provide a surface to which a decorative member may be attached for ornamental purposes. However, such devices provide only a single mode or manner in which they may be attached to the hair, and may be relatively expensive to manufacture depending on the size of the hair clip and complexity of the hinge mechanism.

Ductile metallic members located in sheet-like backing members for wrapping about plastic bags are also known. The common twist-tie for use in wrapping, and twisting to ensure locking, about the mouth of polyurethane bags is one such common household example. The ductile metallic members contained therein are circular ductile wire elements, and usually of a ferrous metal to ensure sufficient tensile strength when stresses are induced through twisting of such twist-tie. It is the common practice in the manufacture of such twist-tie devices to sandwich the ductile wire element between two sheet-like strips of treated paper-like material, primarily to allow such twist-tie members to be easily grasped and separated from one another.

Disadvantages in applying such twist-tie devices for use as an ornamental hair wrap as contemplated in the present invention include the fact that such devices invariably are of a construction wherein a silhouette of the circular ductile wire element protrudes through the surface of the paper-like backing material, creating a cylindrical raised outline throughout the length of the twist-tie. This configuration, in addition to being aesthetically unpleasing when used as a hair wrap, further deprives the twist-tie device of a uniform flat surface to which a decorative ornamental strip or cover member may easily be applied and positively retained thereon despite flexure and coiling of the hair wrap device.

In additon, the sheet-like backing member employed in twist-ties is of paper-like material, or a material lacking any resistance to flexure. Accordingly, during use, the backing member would frequently become folded over along an axis parallel to the circular ductile wire element, and may even become folded unintentionally about the circular wire element, since the paper-like backing member was totally lacking in any resistance to flexure. Although this occurrence is relatively unimportant where the twist-tie is used as a bag closure means, and is even desirable to allow the twist-tie member to be twisted about its ends to allow locking of the twist-tie, it is most clearly undesirable for use in a hair wrap device for two reasons.

Firstly, the hair wrap device of the present invention is not desired to be twisted about its ends to retain hair in a bundle, but rather is adapted to the coiled about a bundle of hair. Accordingly, the surface area of backing member contacting the hair is desired to be as great as possible. Any folding of the backing member would thus decrease the surface area of the backing member contacting the bundle of hair.

Secondly, any folding over of the backing member about the ductile metallic element would also cause folding over of any flexible decorative strip member affixed thereto and accordingly a portion thereof would become hidden from view. This would result in loss of the aesthetic qualities of a decorative hair wrap device, since the decorative strip would appear folded-over along portions of the hair wrap device.

Accordingly, for the above reasons, twist-tie devices and other similar devices are presently unsuited for the intended purpose of the invention described herein.

SUMMARY OF THE INVENTION

The present invention provides for a hair wrap device for coiling about a bundle of hair, having a resilient ductile member therewithin possessing sufficient resistance to bending so that the hair wrap device when manually coiled about a bundle of human hair, retains the hair in said bundle.

In order to overcome the disadvantages inherent in the prior art configurations, in particular the twist-tie configurations, in one broad aspect of the invention it is further provided the ductile metallic member be substantially flat, and located between flat folded-over portions of a backing member, wherein the folded-over portions and the ductile metallic member are of substantially equal thickness in order that they may together form a substantially flat surface, to which a thin, flexible, decorative cover member may accordingly easily be attached, thereby covering and effectively hiding from view the ductile metallic member and increasing the aesthetic appeal of the device.

Accordingly, more particularly, the present invention relates to a hair wrap device for coiling about a bundle of hair to retain the hair in said bundle, and in a first embodiment thereof, comprises:

a thin, substantially rectangular sheet-like backing member having folded portions along at least two parallel side edges thereof folded over onto a top surface of said backing member, a gap being formed on said top surface between edges of said folded-over portions;

a rectangular, substantially flat, manually coilable, ductile metallic member located in the gap, said ductile metallic member and said folded-over portions being of substantially equal thickness so that said folded-over portions and said ductile metallic member together form a substantially flat surface to which a thin, flexible, substantially rectangular decorative cover member is attached;

said cover member overlying at least a portion of each of said folded-over portions so as to bridge the gap along the length thereof and thereby sandwiching the metallic member between said top surface of said backing member and said cover member; and said ductile metallic member possessing sufficient resistance to bending so that said hair wrap device when manually coiled about a bundle of human hair retains the hair in said bundle.

In a second embodiment of the invention, it is alternatively provided that the decorative strip be omitted from the hair wrap device, but that a band roll member be provied within the hair wrap device, located intermediate one side surface of the backing member and the ductile member. By providing the backing member positioned in such manner within the hair wrap device, the outline of the ductible member which is not desired to be seen and which is aesthetically unpleasing, may be prevented from showing through the backing member. Accordingly, the higher-quality and more expensive decorative strip member may be deleted from the construction of the hair wrap device, as its use in covering the ductile member to hide same from view is no longer required.

Accordingly, in another broad aspect of the invention, relating to a hair wrap device for coiling about a bundle of hair to retain the hair in said bundle, such device comprises:

a thin, elongate, substantially rectangular, sheet-like band-roll member having a top and bottom surface;

a thin, elongate, manually coilable, ductile metallic member located along a longitudiual axis of said hair wrap device in mutual overlying relation with said bottom surface of said band-roll member and centrally thereon;

a thin, substantially rectangular manually flexible sheet-like backing member located in mutual overlying relation with said top surface of said band-roll member, having folded portions along at least two paralled but mutually opposite sides thereof folded over said band-roll member;

said band-roll member, when deformed by manually folding said side portions of said backing member and side portions of said band-roll member about said longitudinal axis and around said elongate ductile member, being of sufficient resilience to substantially resist impression thereon of a contour outline of said ductile member and thus prevent said outline being visible through said backing member, and at least partially capable of returning said side edge portions to their original undeformed positions, said band-roll member having insufficient resiliency when said hair wrap device is coiled about a bundle of hair to overcome said resistance to bending of said ductile metallic member; and said ductile member possessing sufficient resistance to bending so that said hair wrap device when manually coiled about a bundle of hair retains the hair in said bundle.

A hair wrap device of the second embodiment may accordingly be coiled about a bundle of human hair, with the surface of the backing member which mutually overlies the band-roll member being exposed to view on the exterior of the coil. The folded-over portions of the backing member, meanwhile, which mutually overlies the ductile member, remain on the interior surface of the hair wrap device when coiled about the hair, thereby remaining hidden from view.

It is contemplated that the hair wrap device of the present invention in the first embodiment thereof be provided in essentially two forms. In a first configuration thereof, the hair wrap device is an elongate band-like member, having an approximate length between about 3"–18", and a width between about ½–1½". In this first configuration, it is contemplated that the hair wrap device be manually repetitiously coiled along its length about a bundle of hair in a concentric manner, with the bundle of hair forming the apex of the spiral, and each successive coil successively overlying the other previously coiled portions.

In this manner the resistance to bending of the hair wrap device may be increased, and the bundle of hair more firmly held.

Alternatively the hair wrap device of the above configuration may be helically wound in a spiral manner about a bundle of hair, effectively encircling the bundle of hair over the length of the helically wound spiral.

In a second configuration of the first embodiment of the invention, wherein the width of the hair wrap device is substantially greater than ½–1½", the hair wrap device may simply be wrapped about a bundle of hair, in the form of a coiled closed loop, with possible overlap between the adjoining ends, relying on the resilient nature of the single loop of ductile metallic member contained within the hair wrap to retain the hair in such bundle.

It is contemplated the ductile metallic member may be either in the shape of a thin elongate strip, or alternatively in the form of a sheet-like member. Where the ductile metallic member is a thin elongate strip, however, it is necessary regardless of whether the thin elongate ductile metallic member is located in a hair wrap device having an elongate shape, as in the first configuration, or in a more square-like shape as in the second configuration, that the hair wrap device be coiled along the length of the ductile member located therewithin, rather than along its width, which may be negligible, in order to allow the coiled ductile member to retain a coiled shape. Where a thin elongate metallic member is aligned within an elongate backing member parallel to the length of the two longest sides thereof, in other words along the length of the hair wrap device, the manner in which the hair wrap device must be coiled is obvious to the user. That is, the hair wrap device must be coiled about its length in order for the ductile metallic member to fulfill its function in retaining the hair wrap device in its coiled position.

It is also possible to use a thin elongate ductile metallic member within the hair wrap device of the second configuration of the first embodiment of the invention. However, such ductile metallic member, if located along the length of the hair wrap device, will only serve to resiliently retain the hair wrap device in a coiled state when the hair wrap device is coiled about its length. Accordingly, since the ductile metallic member within the hair wrap device is necessarily hidden from view by the cover member, it is not readily apparent to a user thereof whether the hair wrap device is to be coiled about its length or its width. Therefore, to avoid the hair wrap device being inoperative if incorrectly coiled about its width, rather than its length, which may be difficult to determine if the hair wrap device is essentially square-like, as in the second configuration of the first embodiment, in a further preferred aspect of the second configuration, the ductile metallic member may be in the shape of a sheet-like material having a width and a length substantially equal to, but less than, the outer dimensions of the hair wrap device. In this aspect the folded-over edge portions are of a relatively small size, and consequently leave a large gap between their edges, allowing a ductile metallic member of sufficient size to be located therein, so that when the hair wrap device, and the ductile metallic member located therewithin, is coiled about either its width or its length, the ductile metallic sheet-like member may resiliently resist uncoiling.

Experimentation with different metallic substances for the ductile metallic member has revealed that copper, particularly in a cold rolled annealed condition, is particularly suitable as the metal for the metallic member, providing when of a thickness betwee 0.010"–0.070" the required resistance to bending necessary to retain the hair in a bundle, but also the necessary ductility to allow manual bending of the metallic member. Copper, in addition to being inexpensive, is also relatively easy to cold roll and cut to a desired size. Other metals or alloys having similar ductility may be used, however.

In a preferred embodiment, where an elongate ductile metallic member is employed, thicknesses between 0.050"–0.070" for such metallic member are preferable when the ductile member is a width between 0.05"–0.15" in order that the metallic member possess sufficient resistance to bending to resist uncoiling. When a sheet-like member is employed, having a much greater width, thicknesses of 0.010"–0.025" may be used, since the increased width of the ductile member compensates for any lost resiliency due to decreased thickness, with the result that the overall resistance to flexure of the hair wrap device remains approximately equal.

In a further aspect of the invention wherein a thin elongate ductile metallic member is incorporated into the hair wrap device, to overcome the disadvantages of possible unintended folding of the side edges of the hair wrap device, and the consequent hiding from view of the decorative cover member provided on such hair wrap device, particularly where the ductile member is a thin, elongate strip and the hair wrap device itself may be 1" or greater in width, it is further contemplated that the backing member be comprised of a material resistant to its flexure and having a memory. Accordingly the backing member, when and in the event of being deformed by folding of either of the folded-over portions about an axis parallel to the ductile metallic member, is of sufficient resiliency to return the folded-over edge portions and the attached decorative cover member to their original position substantially co-planar with the ductile member. The resiliency of the backing member is such, however, that it is not sufficient, when the hair wrap device is coiled along its length about a bundle of human hair, to overcome the resistance to bending of the ductile metallic member to uncoil the hair wrap device from its coiled position about the hair. In this manner the backing surface, and consequently the decorative strip, remain flat over the width of the hair wrap device, to allow the decorative surface to be most clearly displayed.

Materials for which the backing member may be comprised, which substantially meet these requirements and have been found to be particularly suitable, are leather, imitation leather, and vinyl, although other materials having similar resistance to flexure and possessing a memory may also be used.

As a further refinement of the first embodiment of the invention, it is contemplated in a further preferred configuration of the invention that each of the edges of the at least two folded-over portions of the backing member abut respective mutually parallel side edges of the ductile metallic member along substantially the length thereof. In this manner, an even more uniform flat surface comprised of said ductile metallic member and each of said folded-over portions is achieved, upon which the decorative cover member can be affixed. The cover then effectively hides and disguises the existence of the ductile metallic member within the hair wrap device, thereby increasing the aesthetic appearance of the hair wrap.

BRIEF DESCRIPTION OF THE DRAWINGS

Further objects and advantages will appear from the following detailed description of the invention, taken together with the accompanying drawings, in which:

FIG. 4 is a cross-sectional view of the embodiment of the invention shown in FIG. 2, taken along plane A—A of FIG. 2;

FIG. 5 is a cross-sectional view of the invention shown in FIG. 2 along plane A—A, when said hair wrap device of the present invention is deformed along its width, also showing the direction of the resistive restoring forces exerted by the backing member material on the hair wrap device;

FIG. 6 is a perspective view of a second embodiment of the hair wrap device of the present invention and its manner of use affixed in a closed loop fashion about a bundle of human hair;

DETAILED DESCRIPTION OF THE INVENTION

Figure 1:
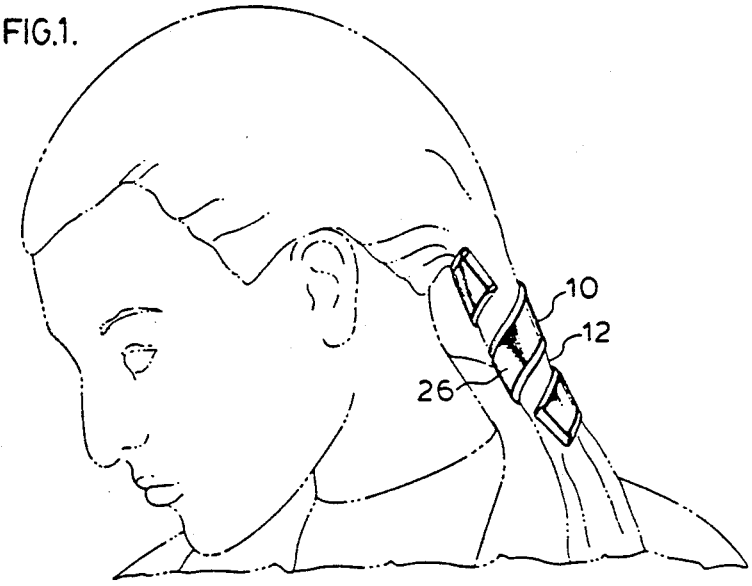
FIG. 1 shows a perspective view of a first embodiment of the wrap device of the present invention and its manner of use when coiled about a bundle of human hair.
Figure 2:
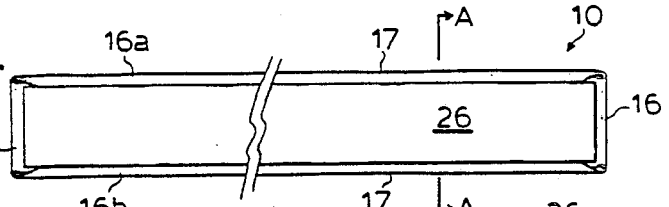
FIG. 2 is a plan view of the first embodiment of the invention shown in FIG. 1 in its flat, uncoiled state.
Figure 3:
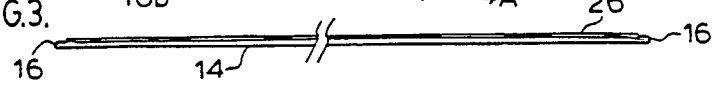
FIG. 3 is a side elevation view of the embodiment of the invention shown in FIG. 2.

As may be seen from FIGS. 1–9 of the drawings, the present invention relates to a hair wrap device 10 for coiling about a bundle of hair 12 to retain the hair in said bundle 12. Such hair wrap device 10 in a first embodiment shown in FIGS. 1–8 comprises a thin, substantially rectangular sheet-like backing member 14 having folded portions 16 along at least two parallel side edges 16*a,b* thereof folded over onto a top surface 18 of said backing member 14, and a gap 20 being formed on said top surface 18 between edges 22 of said folded-over portions 16.

The hair wrap device 10 in all embodiments further comprises a rectangular, substantially flat, manually coilable, ductile metallic member 24 which in the first embodiment of the invention, is located in the gap 20, wherein the ductile metallic member 24 possesses sufficient resistance to bending so that the hair wrap device when manually coiled about a bundle of human hair 12 retains the hair in said bundle 12. Of importance, in the first embodiment of the invention, the ductile member 24 and the folded-over portions 16 are each substantially of equal thickness so that the folded-over portions 16 and the ductile metallic member 24 together form a substantially flat surface to which a thin, flexible, substantially rectangular decorative cover member 26 is attached. The cover member 26 overlies at least a portion of each of the folded-over portions 16 so as to bridge the gap 20 along the length thereof and thereby sandwiching the ductile metallic member 24 between the top surface 18 of the backing member 14, and the cover member 26.

To ensure a more uniform flat surface is presented to which the decorative cover member 26 may be affixed, in a further refinement of the first embodiment of the hair wrap device 10, the edges 22 of the at least two folded-over portions 16*a, b* of said backing member 14 may respectively abut mutually parallel side edges 24*a, b* of the ductile member 24 along substantially the length of the ductile member 24. This allows any interstitial portions in the gap 20 as shown in FIG. 4 between the edges 22 of the folded-over portions 16*a, b* to be eliminated, thereby providing a solid surface to support the flexible decorative cover member 26 and eliminating any possible folding or creasing of the decorative cover member 26 which would detract from the ornamental and asthetic appearance of such decorative cover member 26. The abutment of the edges 22 of the backing member 14 against the side edges 24*a, b* of the ductile member 24 further prevents, in the case of an elongate ductile member, any twisting of the flat ductile member within the gap, thus ensuring that the ductile member will always be coiled about the thickness dimension of such ductile member 24.

In preferred embodiments of the invention, it has been found that cold-rolled copper, or alloys thereof comprised substantially of copper, when in thickneses between 0.010″–0.070″, provide the ideal combination of ductility and resistance to flexure required for the ductile metallic member 24. Substantially pure cold-rolled annealed copper in thicknesses between 0.10–0.070″ have found to be easily manually bendable, yet possess sufficient resilience to flexure to retain a bundle of hair 12 in said bundle 12 when manually coiled about the hair. Other metals possessing comparable ductility and resistance to flexure may also be used, preferably in thicknesses 0.010″–0.070″ to allow a backing member of substantially equal thickness to be selected.

In a particular first configuration of the first embodiment of the invention, as shown in FIGS. 1–5, it is contemplated the backing member 14, cover member 26, and ductile metallic member 24 are each of an elongated shape. The gap 20 is formed between the folded-over portions 16*a, b* edges of the two longest sides 17 of the backing member, so that the gap 20, and consequently the ductile metallic member 24 therewithin, are each aligned within the hair wrap device parallel to the length of the longest sides 17 of the hair wrap device 10, and hence aligned along the length of such device 10.

In such first configuration, it is contemplated that the preferred dimensions of the device 10 be between ¾″ to 1½″ in width, with a length between 3″–18″. In this configuration the hair wrap device 10, although of a width insufficient to allow coiling about a bundle of hair 12, is of a length sufficient to allow manual coiling, either in a helical spiral as shown in FIG. 1, or in overlapping concentric spirals (not shown) about a bundle of hair 12 to retain such hair in the bundle 12.

The ductile metallic member 24 in such first configuration of the first embodiment may be a sheet-like member of a width substantially equal to, but less than, the backing member 14, and extending substantially the length of the hair wrap device 10. In another configuration of the first embodiment, the ductile metallic member 24 is comprised of a thin elongate strip, as shown in cross-section in FIG. 4, of approximately 0.05″–0.15″ in width. It has been found that this particular width, in combination with a thickness of approximately 1/16″ when the ductile member 24 is of cold-rolled copper, provides the ductile member 24 with the properties suitable for the hair wrap device of the present invention.

When ductile member 24 having an elongate shape is utilized in the hair wrap device 10 of the present invention, if the backing member 14 is not comprised of a material somewhat resistant to its flexure, it is very likely that at some point in coiling the hair wrap device 10 about a bundle of hair, the flexible backing member 14, and consequently the flexible decorative cover member 26, may become folded, or twisted about the elongate ductile member 24.

Accordingly, in a further aspect of the hair wrap device 10, provision may be made for backing member 14 to be comprised of a material resistant to its flexure and having a memory, wherein when deformed by further folding of either of said folded-over portions 16*a, b* about the width of the hair wrap device 10 (i.e. about an axis parallel to the ductile metallic member 24), the backing member material is of sufficient resiliency to return the folded-over portions 16*a, b* to their original position substantially co-planar with the ductile member 24, as shown in FIG. 5. This preferred aspect of the invention allows the hair wrap device 10 to more fully meet one of its intended purposes, that is, for providing a flat surface to which a decorative cover member 26 may be affixed and displayed when coiled about a bundle of hair 12. Also, providing a backing member of a material resistant to flexure has the further advantage in the case where the width of the hair wrap device is substantially greater in comparison to the width of the ductile member, since the resilient nature of the backing member will prevent bending of the hair wrap device about its width by the bundle of hair, and hence provide a flat display of the decorative cover member 26, as shown in FIG. 6. FIG. 5 shows the restoring force exerted by the backing member 14 when comprised of such resilient material to re-adjust the hair wrap device, when unintentionally deformed, to the position shown in FIG. 5.

Of note, the selected material should, however, be of insufficient resiliency when the hair wrap device is deformed by coiling along its length to overcome the resistance to bending of the ductile metallic member 26.

Materials which have been found to be operable for such purposes are leather, imitation leather, and vinyls, such as a polyvinyl chloride material. Other materials having the requisite resiliency may also be used.

Figure 7:
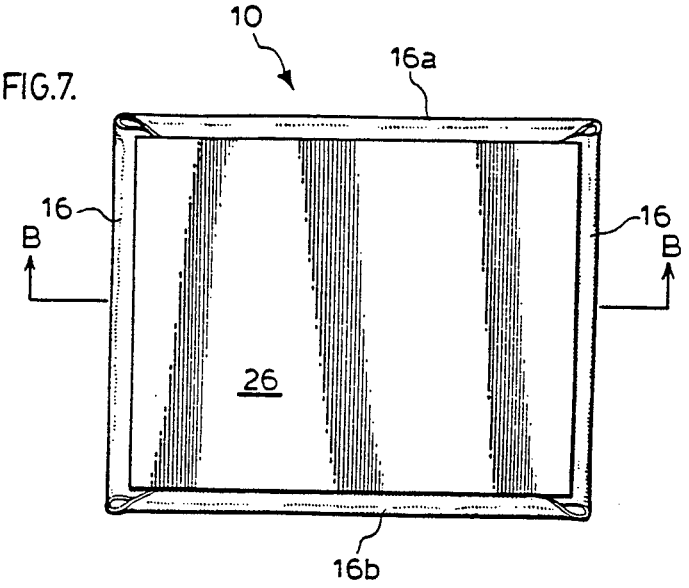
FIG. 7 is a plan view of the embodiment of the invention shown in FIG. 6 in its flat, uncoiled state.
Figure 8:
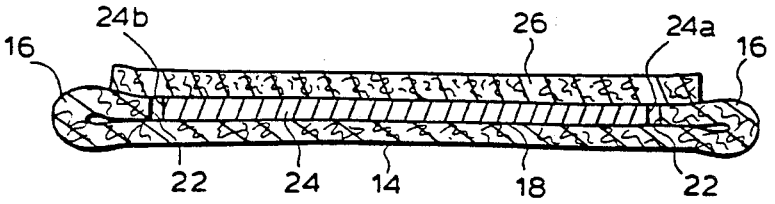
FIG. 8 is a cross-sectional view of the embodiment of the invention shown in FIG. 7, taken along plane B—B of FIG. 7.

In a second configuration of the first embodiment of the invention, shown in FIGS. 6–8, the shape of the hair wrap device may be such that the length and width of the device 10 are substantially equal, allowing the hair wrap device to be coiled along either its length or its width about a bundle of hair. Of course, if a thin elongate ductile member 24 is used, and is located in the gap 20 along the length of the device 10, the hair wrap device although capable of being coiled along either its length or its width, is only able to retain a coiled shape if it is coiled along its length along which the ductile metallic member 24 is aligned therewithin. Accordingly, it is not apparent to a user of the hair wrap device 10, where such device has a substantially square-like shape, whether the device is intended to be folded about its length or its width. Accordingly, in a preferred aspect of the second configuration of the first embodiment, it is contemplated the ductile metallic member 24 possess a sheet-like configuration as shown in FIG. 8, and a surface area substantially equal to, but less than, the backing member 14. In this manner the hair wrap device, when coiled about a bundle of hair along either its length or width, will cause deformation of the ductile metallic member 24, along an axis paralled to its width, or parallel to its length. Accordingly, the ductile sheet-like metallic member 24 may then serve to resiliently retain the hair wrap device 10 in a coiled state about a bundle of hair 24, regardless of whether the hair wrap device is coiled about its length or its width.

Figure 9:
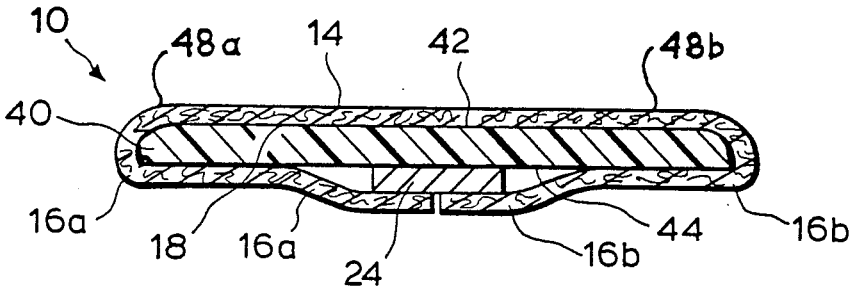
FIG. 9 is a cross-sectional view of a second embodiment of the invention, similar to the cross-sectional view of the invention taken in FIG. 8.

FIG. 9 shows a second embodiment of the invention for an elongate hair wrap device 10, whereby the decorative strip member 26 has been omitted, and a thin elongate, sheet-like band-roll member 40 provided, encircled by folded side portions 16*a*, 16*b* of the backing member 14, which are folded over onto the band-roll member 40.

The band-roll member 40 further possesses a top surface 42 which is in mutually overlying relation with the top surface 18 of the backing member 16, as shown in FIG. 9. The bottom surface 44 of the band-roll member 40 is overlaid by the ductile metallic member 24, which is located along a longitudiual axis of the hair wrap device 10 in mutual overlying relation with the band-roll member 40 and centrally therein, as shown in FIG. 9.

The band-roll member 40, when deformed by manually folding the folded side portion 16*a*, 16*b* of the backing member and side portion of the band-roll member 40 about the longitudiual axis and around the elongate ductile member 24, is of sufficient resilience and/or thickness to substantially resist impression thereon of the contour outline of the ductile member 24. Accordingly, the band-roll member 40 prevents the contour outline of the ductile member 24 being visible through the backing member when viewed from the exterior surface 14 hereof, thereby improving the aesthetic appearance of the hair wrap device 10. The band-roll member 40 is further of sufficient resilience to be partially capable of returning the side portions 48*a*, 48*b* to their original undeformed positions, as shown in FIG. 9, but is of insufficient resiliency when the hair wrap device 10 is coiled about a bundle of hair to overcome the resistance to bending of the ductile metallic member 24, and accordingly remains coiled about the bundle of hair.

In a further refinement of the above second embodiment, as an alternative to allowing the ends of the folded portions 16*a*, 16*b* to abut each other, as shown in FIG. 9, such ends may be allowed to overlap each other so as to lie in mutual overlapping with each other, thereby covering the ductile metallic member 24 (not shown).

In either configuration of the second embodiment, it is contemplated that the ductile metallic member 24 be located on the side 44 of the band-roll member upon which the folded portions 16*a*, 16*b* are folded over, since it is irrelevant whether the contour outline of the ductile metallic member 24 is discernable through the folded-over portions 16*a*, 16*b* of the backing member 14, since this particular surface will be hidden from view when coiled about the bundle of hair. It is important, however, that the band-roll member 40 be interposed intermediate the top surface 18 of the backing member 14, and the ductile member 24, in order to prevent the top surface 18 of the backing member from conforming to the contour outline of the ductile member 24, and thereby allowing the outline of the ductile member 24 to be discernable therethrough.

Although the description describes preferred embodiments of the invention, it is not to be limited to such embodiments. Other variations may now become apparent to persons skilled in the art. For a complete definition of the invention, reference should be made to the claims appended to this specification.

The embodiments of the invention in which an exclusive property or privilege is claimed are defined as follows:

1. A hair wrap device for coiling about a bundle of hair to retain the hair in said bundle, comprising:

a thin, substantially rectangular sheet-like backing member having folded portions along at least two parallel sides thereof folded over onto a top surface of said backing member, a gap being formed on said top surface between edges of said folded over portions;

a rectangular, substantially flat, manually coilable, ductile metallic member, located in the gap, said ductile metallic member and said folded-over portions being of substantially equal thickness so that said folded-over portions and said ductile metallic member together form a substantially flat surface to which a thin, flexible, substantially rectangular decorative cover member is attached;

said cover member overlying at least a portion of each of said folded-over portions so as to bridge the gap along the length thereof and thereby sandwiching the metallic member between said top surface of said backing member and said cover member; and said ductile metallic member possessing sufficient resistance to bending so that said hair wrap device when manually coiled about a bundle of human hair retains the hair in said bundle.

2. The hair wrap device as claimed in claim 1, wherein each of the edges of the at least two folded-over portions of said backing member abut respective mutually parallel side edges of said ductile metallic member along substantially the length thereof.

3. The hair wrap device as claimed in claim 1 or 2, wherein said ductile metallic member has a sheet-like configuration, and a surface area substantially equal to, but less than, said backing member, said hair wrap device of sufficient length and width to allow coiling thereof along either its length or width about a bundle of human hair to retain said hair in said bundle.

4. The device as claimed in claim 1 wherein said backing member, cover member, and ductile member are each of an elongate shape, said backing member having two parallel sides longer than its others, said gap extending parallel to the length of said two longest sides.

5. The hair wrap device as claimed in claim 4, wherein said ductile metallic member is comprised of a thin strip approximately 0.05"–0.15" in width.

6. The hair wrap device as claimed in claim 1, said backing member comprised of a material resilient to its flexure and having a memory, wherein said material, when said backing member is deformed by further folding of either of said folded-over portions about an axis parallel to said ductile metallic member, is of sufficient resiliency to return said folded-over portions to their original position substantially coplanar with said ductile member, but is of insufficient resiliency, when said hair wrap device along its length is coiled about said bundle of human hair, to overcome said resistance to bending of said ductile metallic member to uncoil said hair wrap device.

7. The hair wrap device as claimed in claim 6, wherein said backing member is substantially comprised of a material selected from the group of materials consisting of leather, imitation leather, and vinyl.

8. The hair wrap device as claimed in claim 1, wherein said ductile metallic member is substantially comprised of copper.

9. The hair wrap device as claimed in claim 8, wherein said ductile metallic member is between 0.10″–0.070″ in thickness.

* * * * *